United States Patent [19]

Hechinger

[11] 4,195,857

[45] Apr. 1, 1980

[54] SKATEBOARD WITH ADJUSTABLE TAIL SECTION

[76] Inventor: Albert R. Hechinger, 11944 Weir St., Culver City, Calif. 90230

[21] Appl. No.: 931,366

[22] Filed: Aug. 7, 1978

[51] Int. Cl.[2] ..... A63C 17/00

[52] U.S. Cl. ..... 280/87.04 A; 280/11.19

[58] Field of Search ..... 280/87.04 R, 87.04 A, 280/11.1 BT, 11.2, 11.27, 11.28

[56] References Cited

U.S. PATENT DOCUMENTS

| | | | |
|---|---|---|---|
| 3,565,454 | 2/1971 | Stevenson | 280/87.04 A |
| 4,092,033 | 5/1978 | Swain | 280/87.04 A |
| 4,120,510 | 10/1978 | Hillard | 280/87.04 A |

*Primary Examiner*—Joseph F. Peters, Jr.
*Assistant Examiner*—Michael Mar
*Attorney, Agent, or Firm*—Fulwider, Patton, Rieber, Lee & Utecht

[57] ABSTRACT

A skateboard with an elongated platform having a tail section and a main body section coupled together by an angularly adjustable joint that holds the sections in a preselected angular relation and permits adjustment of the tail section to various angles relative to the plane of the body section. In one embodiment, the adjustable joint is an elongated plate having front and rear end sections secured to the body and tail sections, respectively, of the skateboard platform, and, extending between the front and rear sections, an intermediate section that is bendable to a preselected angle, but has sufficient strength and stiffness to resist bending under the normal forces exerted on the tail section during tilting of the skateboard. In an alternative embodiment, the adustable joint is an elongated plate with front and rear sections, with the front section being secured to the body section of the platform and the rear section being covered with a pliable nonslip plastic or rubber material to form the tail section of the platform, so that the tail section itself can be curved as well as angularly adjusted relative to the body section. In another alternative embodiment, the angularly adjustable joint is a hinge with front and rear hinge elements secured to the body and tail sections, respectively, of the skateboard platform, and connected together by a pivot pin. The pin has a threaded end engageable with a nut for locking the tail section in its preselected angular position by placing the hinge elements in compressive engagement.

7 Claims, 5 Drawing Figures

Fig. 1
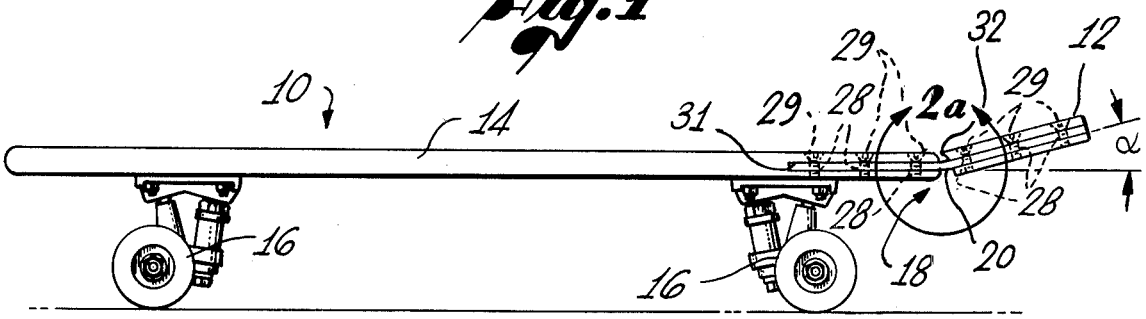
Fig. 2a
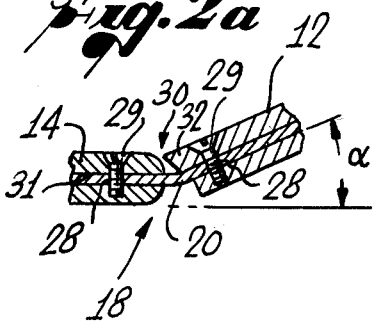
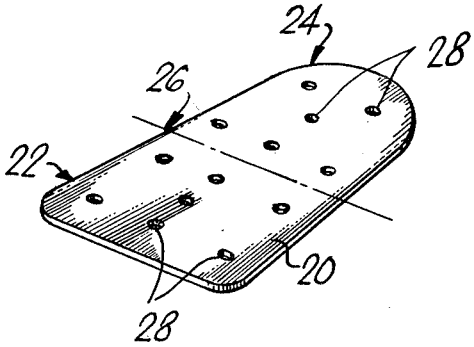
Fig. 2
Fig. 3
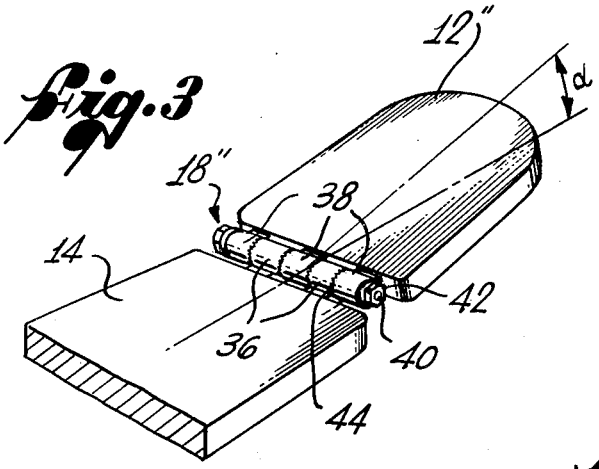
Fig. 4
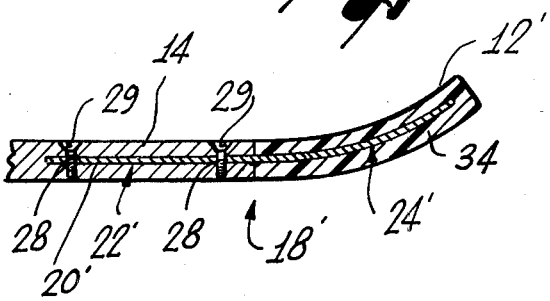

SKATEBOARD WITH ADJUSTABLE TAIL SECTION

BACKGROUND OF THE INVENTION

This invention relates generally to skateboards, and, more particularly, to skateboards having upwardly angled rear overhang sections to facilitate turning and riding over obstacles.

As is now well known, a skateboard is a recreational device upon which a person can ride for entertainment or exercise. Control of the skateboard is principally determined by the distribution of the rider's weight on the skateboard, with turning and tilting of the skateboard being accomplished by shifts in the rider's weight and position.

A conventional skateboard includes an elongated platform for supporting a skateboard rider, and front and rear wheel assemblies mounted on the underside of the platform. Since these wheel assemblies are positioned inwardly from the front and rear ends of the skateboard platform, the portions of the platform that extend beyond the wheel assemblies form front and rear overhang sections.

In order to turn a skateboard or to position it in preparation for riding over obstacles such as curbs, the skateboard rider frequently must raise the front wheels of the skateboard off the ground by tilting the skateboard platform. This is usually accomplished by using the rear overhang section of the skateboard platform as a lever, allowing the rider to tilt up the front end of the skateboard by pressing down with his foot on the rear overhang section.

Such use of the rear overhang section requires that it extend sufficiently beyond the rear wheel assembly to provide an adequate surface area for placement of the rider's foot, and to provide an adequate lever for tilting the skateboard. Since all early skateboard platforms were substantially flat, when the rear overhang section was extended sufficiently beyond the rear wheel assembly to satisfy these requirements, the overhang section would drag on the ground when the skateboard was in an only slightly tilted attitude. In the past this problem was minimized by the fabrication of skateboard platforms with upwardly curved tail sections.

Conventional skateboards with curved tail sections are typically made of molded plastic, laminated wood or solid wood, and have the curve of the tail section permanently set at a fixed angle with respect to the main body section of the skateboard platform during the manufacturing process. As a result, a particular style of skateboard with a curved tail section is generally offered for sale in only one or two tail section angles. However, since the advent of the curved tail section skateboard, riders have come to realize that the angle of the tail section is an important factor in determining skateboard performance, and that there is no single optimum angle that suits the needs and preferences of every rider. Furthermore, the optimum tail section angle for any particular rider at any particular time varies substantially, depending on such factors as the rider's ability and style of riding, and the use to which he puts the skateboard.

A disadvantage of skateboards with fixed-angle tail sections is that a rider frequently cannot purchase a skateboard with the precise angle he desires, and that, as a rider's ability and riding style change, the angle of the tail section cannot be adjusted to accommodate the rider's new requirements. A further disadvantage of skateboards with fixed-angle tail sections is that, if a single rider uses a skateboard under various conditions, such as street skating, downhill racing, slalom racing, riding on curved surfaces in skateboard parks and trick skating, he has to purchase several different skateboards with the appropriate tail section angles for his intended uses.

There are also cost disadvantages to manufacturers and retailers of fixed-angle tail section skateboards. One results from the difficulty encountered in producing curvature in the tail section of a laminated or solid wood platform. The curving processes presently employed are time consuming and require elaborate presses, forms, molds and other equipment, all of which contribute to an increase in the cost of production.

Another cost disadvantage of skateboards with fixed-angle tail sections, regardless of the material used for the platform, results from the increased production cost and capital required if manufacturers and retailers desire to make and offer for sale a particular style of skateboard in more than one tail section angle. Since the angle of the tail section is fixed during fabrication of the skateboard platform, manufacturing a platform in more than one tail section angle requires either several manufacturing lines, or cessation of production to make the necessary equipment changes for each new angle. In addition, increased inventory expense is incurred since manufacturers and retailers who wish to offer a skateboard in more than one tail section angle have to stock skateboards with each of the angles offered.

It will be apparent from the foregoing that there has long been a need for an improved skateboard that obviates these problems by providing an adjustably coupled tail section that can be set to the tail section angle that best suits the rider's preference and intended use, and can be subsequently readjusted as the need arises. The present invention fulfills this need.

SUMMARY OF THE INVENTION

The present invention resides in a skateboard with an angularly adjustable tail section, constructed to allow selective adjustment to the tail section angle that best suits the rider's preference and intended use. The skateboard of the invention can be manufactured at relatively low cost, and obviates the need to provide purchasers with a selection of skateboards with different tail section angles. Basically, and in general terms, the skateboard of the invention comprises an elongated platform having a main body section and a tail section, and an angularly adjustable joining means for coupling the tail section and the main body section together in a preselected angular relation, while still permitting adjustment of the tail section to various angles relative to the plane of the body section.

In a preferred embodiment of the invention, the adjustable joining means or joint is an elongated plate with sufficient strength and stiffness to resist bending under the normal forces exerted on the tail section during tilting of the skateboard, but which is not so rigid as to prevent bending of the plate when adjusting the angle of the tail section. The plate has a front end section and a rear end section secured to the body section and the tail section, respectively, of the skateboard, and has an intermediate section, between its front and rear end sections, through which the plate is bendable to form a preselected angle between the body and tail sections.

Although any suitable metal may be used for the plate, an aluminum plate of aporoximately five inches in length and three inches in width, and with a thickness of between one-sixteenth of an inch and one-eighth of an inch has been found to have sufficient strength and stiffness for the requirements of the invention. Of course, the optimum thickness of the plate will depend on its width and on the plate material used.

To minimize the platform surface discontinuity that results from having a separate tail section, the front end of the tail section is provided with a forwardly projecting lip that effectively closes the gap between the body section and the tail section as the tail section is bent upwardly.

In an alternative embodiment of the invention, the angularly adjustable joint is again an elongated plate that has a front section and a rear section, with the front section being secured to the body section of the skateboard platform. The tail section is formed by covering the rear end section of the plate with a pliable nonslip plastic or rubber material that allows both the angle and the shape of the tail section to be adjusted relative to the plane of the body section.

In another alternative embodiment of the invention, the adjustable joint is a hinge having front and rear hinge elements secured to the body section and the tail section, respectively, of the skateboard platform. A pin is used to connect the hinge elements together and to permit the tail section to pivot with respect to the body section. Placing the hinge elements in compressive engagement, along the hinge axis, inhibits the relative movement of the tail and body sections from their preselected angular position. The hinge pin may be a bolt threaded to accept a nut, with locking of the hinge elements being accomplished by tightening of the nut. The cooperating surfaces of the front and rear hinge elements may be provided with teeth that interlock when the bolt is tightened, in order to further prevent relative movement of the hinge elements.

Other features and advantages of the invention will become apparent from the following detailed description, taken in conjunction with the accompanying drawings.

BRIEF DESCRIPTION OF THE DRAWINGS

FIG. 1 is a side elevational view of a skateboard having an adjustably coupled tail section embodying the present invention;

FIG. 2 is a perspective view of the plate shown in FIG. 1;

FIG. 2*a* is an enlarged cross-sectional view of the section of the skateboard shown in circle 2*a* in FIG. 1;

FIG. 3 is a fragmentary perspective view of an alternative embodiment of the invention; and FIG. 4 is a fragmentary cross-sectional view of another alternative embodiment of the invention.

DETAILED DESCRIPTION

As shown in the drawings for purposes of illustration, the present invention is embodied in a skateboard with an adjustably coupled tail section. The skateboard, generally indicated by reference number 10, includes an elongated platform, having top and bottom sides and front and rear ends, comprising a main body section 14 and a tail section 12 for supporting a skateboard rider. The skateboard further includes front and rear wheel assemblies 16 which are mounted on the bottom side of the main body section 14 in longitudinally spaced relation with each other and with the ends of the platform 10.

In accordance with the present invention, the rear tail section 12 is separated from and angularly movable relative to the main body section 14, with the sections being coupled by an angularly adjustable joint, generally indicated by reference numeral 18, that holds the sections in a preselected angular relation and permits adjustment of the tail section to various angles, indicated by the Greek letter $\alpha$, relative to the plane of the body section.

In the embodiments shown in FIGS. 1, 3 and 4, the angularly adjustable joint 18 couples the tail section 12 to the main body section 14 as a longitudinal extension thereof. When the angle $\alpha$ of the tail section relative to the plane of the body section is greater than zero, the two sections form a platform which allows tilting of the skateboard in the same manner as with a conventional skateboard with a fixed, curved tail section.

The adjustable joint 18 of the preferred embodiment shown in FIGS. 1 and 2*a*, is an elongated plate 20 with sufficient strength and stiffness to resist bending under the normal forces exerted on the tail section 12 during tilting of the skateboard 10, but yet not rigid enough to prevent bending of the plate when adjusting the angle $\alpha$ of the tail section.

The plate 20 (see FIG. 2) has a front end section 22 and a rear end section 24 secured to the body section 14 and the tail section 12, respectively, of the skateboard platform (see FIG. 1). The plate also has an intermediate section 26 extending between its front and rear end sections, the plate being bendable at its intermediate section to form the preselected angle. The plate may be made from any suitable metal, such as aluminum, titanium or steel. An aluminum plate approximately five inches long and three inches wide, and with a thickness of between one-sixteenth of an inch and one-eighth of an inch has sufficient strength and stiffness to function as intended. It will be appreciated that the wider the plate, the thinner it can be. As shown in FIG. 2, the plate preferably has holes 28 to receive suitable fasteners 29, such as screws, bolts or rivets, for securing the plate to the body and tail sections 14 and 12.

Although, as shown in FIG. 1, the front end section 22 of the plate 20 need only be of sufficient length to provide secure attachment to the body section 14, the plate may extend the entire length of the body section, or any portion thereof, to provide added strength and flexibility to the skateboard platform.

The front end section 22 of the plate 20 may be attached to the body section 14 of the platform by insertion of the front end section into a corresponding slot 31 formed at the rear end of the body section, and appropriately sized to receive the plate, which is secured therein by the fasteners 29. The slot can be formed by any convenient means, such as by sawing or routing for wood skateboards, or by molding the slot into plastic or fiberglass skateboards. In fiberglass and plastic skateboards, the front end section 22 of the plate 20 may be secured to the body section 14 as an integral part thereof, by molding the body section around front end section during fabrication. As an alternative form of construction, the plate 20 may be secured to the bottom side or top side of the body section 14. However, if secured to the top side, the plate should be recessed to provide a smooth top platform surface.

As shown in FIG. 1, the tail section 12, is essentially flat, and is secured to the rear end section 24 of the plate 20. As with the front end section 22, the rear end section of the plate need only be of sufficient length to provide secure attachment to the tail section, or may, as shown, extend the entire length of the tail section.

To provide a more continuous top platform surface, the gap 30 between the body section 14 and the tail section 12 may be minimized by providing a forwardly projecting lip 32 on the front end of the tail section (see FIGS. 1 and 2*a*). The lip effectively closes the gap as the tail section is upwardly bent relative to the plane of the body section. Tape (not shown) may be used to cover any gap that remains once the tail section is bent to the desired angle.

In the alternative embodiment of the invention shown in FIG. 4, an angularly adjustable joint 18′ is also provided, and takes the form of an elongated plate 20′ that has a front section 22′ and a rear section 24′, with the front section being secured to the body section 14 of the skateboard platform. The tail section 12′ in this embodiment is formed by covering the rear section 24′ of the plate with a pliable nonslip plastic or rubber material 34. Although, for the purposes of illustration, the top and bottom surfaces of the rear section 24′ are both coated, only the upper surface need be coated to provide the rider with a nonslip surface on which to place his foot. Fabricating the tail section of the platform in this manner allows both the shape and the angle of the tail section relative to the body section to be adjusted.

Another alternative embodiment of the present invention is shown in FIG. 3. In this embodiment there is provided an adjustable joint 18″ that is a hinge having front and rear hinge elements 36 and 38, secured to the body section 14 and the tail section 12″, respectively, of the skateboard platform. The hinge elements are connected together by a pin 40 to pivot the tail section with respect to the body section, and may be selectively locked to inhibit relative movement from a preselected angular position. In the illustrated embodiment, the pin 40 consists of a bolt that is threaded to accept a nut 42, and locking is accomplished by tightening the nut and placing the hinge elements in compressive engagement, along the hinge axis. To further prevent relative movement of the hinge elements, the cooperating surfaces of the front and rear hinge elements have teeth 44 that interlock when the bolt is tightened.

It will be appreciated from the foregoing description that the present invention represents a significant advance in the field of skateboards. In particular, it provides a single skateboard that can be set to the tail section angle that best suits the rider's preference and intended use, and can be subsequently readjusted as the need arises. Moreover, use of the invention reduces the manufacturing cost of curved-tail skateboards, and eliminates the inherent cost of providing purchasers with skateboards having a selection of tail section angles. It will also be appreciated that, although specific embodiments of the invention have been described herein for the purposes of illustration, various modifications may be made without departing from the spirit and scope of the invention.

I claim:

1. A skateboard comprising:

an elongated platform having a main body section and a rear tail section angularly movable relative to said main body section;

an angularly adjustable joint coupling said tail section to said main body section as a longitudinal extension thereof, said joint having an elongated plate with sufficient strength and stiffness to resist bending under the normal forces exerted on said tail section during use of the skateboard, said plate having front and rear end sections secured to said main body section and said tail section, respectively, and an intermediate section extending between said front and rear end sections, said intermediate section being bendable to a preselected angle to hold said tail section at said preselected angle relative to said body section; and wheel assemblies mounted on the bottom side of said main body section, in longitudinally spaced relation with each other and with the ends of said platform.

2. A skateboard as defined in claim 1, wherein the front end of said tail section, adjacent to said main body section, includes a forwardly projecting lip, whereby the gap between said platform sections is reduced as said tail section is bent upwardly to a preselected angle.

3. A skateboard as defined in claim 1 wherein said plate is constructed of aluminum with a thickness of between one-sixteenth of an inch and one-eighth of an inch.

4. A skateboard comprising:

an elongated platform having a main body section and a rear tail section angularly movable relative to said main body section;

an angularly adjustable joint coupling said tail section to said main body section as a longitudinal extension thereof, said joint having front and rear hinge elements secured to said main body section and said tail section, respectively, a pin connecting said front and rear hinge elements together to pivot said tail section with respect to said body section, and selectively operable means for locking said hinge elements to prevent relative movement from a preselected angular position, to hold said tail section at said preselected angle relative to said body section; and wheel assemblies mounted on the bottom side of said main body section, in longitudinally spaced relation with each other and the ends of said platform.

5. A skateboard as defined in claim 4, wherein said pin comprises a bolt.

6. A skateboard as defined in claim 4, wherein said means for locking comprises a bolt threaded to accept a nut, whereby said hinge elements are placed in compressive engagement upon tightening of said nut.

7. A skateboard as defined in claim 6, wherein said hinge elements have cooperating surfaces with teeth, whereby said teeth interlock upon tightening of said nut.

* * * * *